US009394080B2

(12) United States Patent
Beck

(10) Patent No.: US 9,394,080 B2
(45) Date of Patent: Jul. 19, 2016

(54) ADJUSTABLE AMMUNITION MAGAZINE POUCH

(71) Applicant: Tyr Tactical, LLC, Peoria, AZ (US)

(72) Inventor: Jason Beck, Peoria, AZ (US)

(73) Assignee: Tyr Tactical, LLC, Peoria, AZ (US)

( * ) Notice: Subject to any disclaimer, the term of this patent is extended or adjusted under 35 U.S.C. 154(b) by 346 days.

(21) Appl. No.: 13/829,894

(22) Filed: Mar. 14, 2013

(65) Prior Publication Data

US 2014/0262842 A1 Sep. 18, 2014

(51) Int. Cl.

| | |
|---|---|
| ***B65D 21/08*** | (2006.01) |
| ***A45C 7/00*** | (2006.01) |
| ***A45C 13/30*** | (2006.01) |
| ***F42B 39/02*** | (2006.01) |
| ***F42B 39/26*** | (2006.01) |

(52) U.S. Cl.

CPC ..... *B65D 21/08* (2013.01); *A45C 7/0063* (2013.01); *A45C 13/30* (2013.01); *F42B 39/02* (2013.01); *F42B 39/26* (2013.01); *Y10T 29/49826* (2015.01)

(58) Field of Classification Search

CPC .. A45C 7/0063; A45C 7/0068; A45C 7/0077; A45C 13/1046; A45C 13/1038; A45C 13/30; A45C 7/0022; B65D 33/007; B65D 33/165; B65D 33/28; B65D 21/08; F42B 39/00; F42B 39/02; F42B 39/26

USPC ..... 206/3; 383/2; 224/239, 931, 919, 930, 224/581

See application file for complete search history.

(56) References Cited

U.S. PATENT DOCUMENTS

| | | | | |
|---|---|---|---|---|
| 4,919,240 | A * | 4/1990 | Tobias | 190/103 |
| 5,484,093 | A | 1/1996 | Hellweg et al. | |
| 5,704,528 | A * | 1/1998 | Faure | 224/583 |
| 6,202,908 | B1 | 3/2001 | Groover | |
| 6,398,410 | B1 * | 6/2002 | Guerra | 383/24 |
| 8,231,038 | B2 | 7/2012 | Felts | |

(Continued)

FOREIGN PATENT DOCUMENTS

| | | |
|---|---|---|
| FR | 2885019 | 11/2006 |
| FR | 2940249 | 6/2010 |

(Continued)

OTHER PUBLICATIONS

Australian Examination Report dated Nov. 26, 2014 for corresponding application No. 2014200881.

(Continued)

*Primary Examiner* — Anthony Stashick
*Assistant Examiner* — Robert Poon
(74) *Attorney, Agent, or Firm* — Polsinelli PC

(57) ABSTRACT

An adjustable pouch having a front portion, rear portion, first side portion, and a second side portion that are connected to a bottom portion and collectively defines an interior space that may be configured to receive different sizes of ammunition magazines is disclosed. The front and rear portions include a plurality of straps that extend lengthwise and the first and second side portions include a plurality of channels. The plurality of straps and the plurality of channels are configured to receive an elastic member having free ends that are tied together. In operation, an individual can pull on the tied free ends of the elastic member in order to adjust the volume of the interior space to accommodate ammunition magazines of different sizes.

28 Claims, 4 Drawing Sheets

(56) References Cited

U.S. PATENT DOCUMENTS

| | | | | |
|---|---|---|---|---|
| 2005/0056643 | A1* | 3/2005 | Hagan et al. | 220/9.3 |
| 2007/0017947 | A1* | 1/2007 | Fenton et al. | 224/650 |
| 2008/0061099 | A1* | 3/2008 | Tilby | 224/666 |
| 2011/0243482 | A1* | 10/2011 | First et al. | 383/72 |
| 2012/0091173 | A1 | 4/2012 | Crye | |
| 2012/0111882 | A1* | 5/2012 | Milligan et al. | 221/1 |

FOREIGN PATENT DOCUMENTS

| | | |
|---|---|---|
| GB | 1019554 | 2/1966 |
| WO | WO 2014134368 | 9/2014 |

OTHER PUBLICATIONS

Safariland, Model 773 Adjustable Magazine Pouch, http://www.safariland.com/DutyGear/product.aspx?pid=773, printed Jan. 31, 2013.

Patent Examination Report No. 2 from Australian Patent Office, relating to Patent Application No. 2014200881, dated Jun. 13, 2015, 3 pages.

Response to Examiners First Report filed May 27, 2015 for corresponding Australian App No. 2014200881.

Response to Examiner's Second Report filed Jun. 26, 2015 for corresponding Australian App No. 2014200881, 11 pages.

Examiners Search Report dated Jul. 9, 2015 for corresponding European App No. 14158649.5, 6 pages.

Rule 69 Examiner's Search Report dated Aug. 17, 2015 for corresponding European App No. 14158649.5, 8 pages.

Office Action dated Jul. 7, 2015 for corresonding Canadian App No. CA 2,843,940, 4 pages.

HSGI TACO Magazine Pouch Review, Chairsoft-Press.com, archived Oct. 12, 2011, 7 pages. [retrieved from: https://web.archive.org/web/20111012180939/http://chairsoft-press.com/reviews/gear/hsgi-taco-magazine-pouch-review/].

HSGI Bungee Installation [SIC] on a TACO, uploaded Jul. 9, 2010, 2 pages [retrieved from: https://www.youtube.com/watch?v=PVkqGEVu_Ko].

HSGI Open Top Universal Mag Pouch Modular, Double, skdtac.com, archived Jan. 21, 2012, 3 pages [retrieved from https://web.archive.org/web/20120121030732/http://www.skdtac.com/HSGI-Open-Top-Universal-Mag-Pouch-Modular-p/hsg.226.htm].

HSGI 'TACO' Modular Single Rifle Magazine Pouch, sdktac.com, archived Oct. 31, 2011, 3 pages [retrieved from: http://www.skdtac.com/HSGI-TACO-Modular-Single-Rifle-Magazine-Pouch-p/hsg.227.htm].

* cited by examiner

ADJUSTABLE AMMUNITION MAGAZINE POUCH

FIELD

The present document relates to an adjustable pouch for receiving an article, and in particular to an adjustable pouch configured to store different types of ammunition magazines.

BACKGROUND

Pouches are used for storing various articles. In tactical applications, pouches may be configured to store ammunition magazines for different types of weapons. Since ammunition magazines have different shapes and sizes, it is a necessary requirement that the pouch have the capability to accommodate different kinds of ammunition magazines. As such, it is desirable for improvements in pouches that are adjustable to accommodate ammunition magazines of different sizes.

SUMMARY

In one embodiment, an adjustable pouch may include a pouch body having a front portion, a rear portion, a first side portion, and a second side portion that are connected to a bottom portion that collectively define an interior space. A first plurality of channels is defined by the first side portion and a second plurality of channels is defined by the second side portion. In addition, a first plurality of straps is attached to the front portion of the pouch body and a second plurality of straps is attached to the rear portion of the pouch body. An elastic member is configured to be received through the first and second plurality of channels and the first and second plurality of straps such that the elastic member binds the pouch body together and is adjustable to modify the shape of the interior space of the pouch body.

In another embodiment, a method of manufacturing an adjustable pouch may include:

- forming a pouch body comprising:
  - a front portion, a rear portion, a first side portion, a second side portion that are connected to a bottom portion and collectively define an interior space;
  - a first plurality of channels defined by the first side portion; and
  - a second plurality of channels defined by the second side portion;
- attaching one or more straps to the front portion;
- attaching one or more straps to the rear portion;
- folding the front portion and the rear portion toward the other, while folding the first side portion and the second side portion toward the other to collectively define an interior space; and
- inserting an elongated elastic member through the first plurality of channels of the first side portion, the second plurality of channels of the second side portion, the one or more straps of the front portion, and the one or more straps of the rear portion, wherein the elongated elastic member defines an elongated body with a first free end and a second free end, wherein the elongated elastic member.

Additional objectives, advantages and novel features will be set forth in the description which follows or will become apparent to those skilled in the art upon examination of the drawings and detailed description which follows.

BRIEF DESCRIPTION OF THE DRAWINGS

Corresponding reference characters indicate corresponding elements among the view of the drawings. The headings used in the figures do not limit the scope of the claims.

DESCRIPTION

Figure 1:
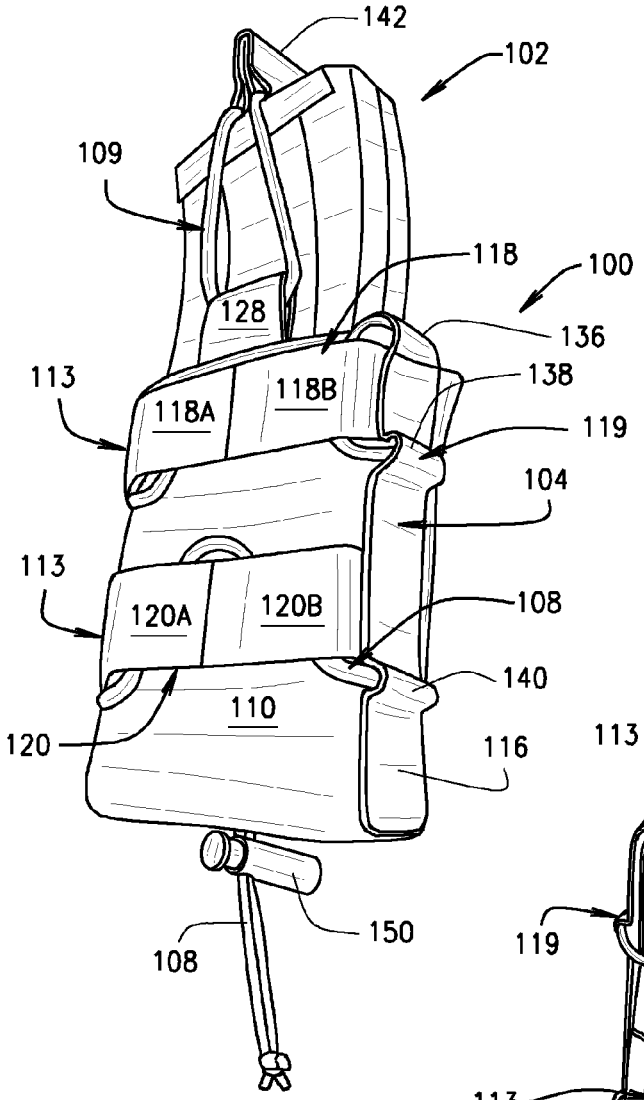
FIG. 1 is an elevated perspective view of an adjustable pouch for engagement to an ammunition magazine.

An adjustable pouch having a pouch body configured to receive different types of articles, such as an ammunition magazine, using an elongated elastic member that binds together different portions of the pouch body such that an interior space defined by the adjustable pouch can be adjusted to accommodate ammunition magazines of different shapes and sizes is described herein. Referring to the drawings, various embodiments of an adjustable pouch are illustrated and generally indicated as 100 in FIGS. 1-10. As illustrated in FIG. 1, the adjustable pouch 100 includes a pouch body 104 configured to receive various types of articles, such as an ammunition magazine 102, in which one portion of the ammunition magazine 102 is received within an interior space 106 (FIG. 7) defined by the pouch body 104, while the remainder of the ammunition magazine 102 extends outwardly from the interior space 106 through an opening 121 (FIG. 7) of the pouch body 104. As further shown, the pouch body 104 includes a front portion 110, a rear portion 112, a first side portion 114, a second side portion 116 that collectively extend from a bottom portion 117 to define the interior space 106 when bound together using a first elongated elastic member 108. In some embodiments, the first elongated elastic member 108 may define an elongated body with a first free end and a second free end. In addition, the first elongated elastic member 108 may be a chord, a rope, a string or other type of elongated stretchable member made of a material that exhibits elastic or stretching qualities that allow the first elongated elastic member 108 to be stretched, tied together and/or be configured to apply a bias that binds the front portion 110, rear portion 112, first side portion 114, and second side portion 116 together to accommodate different sizes of ammunition magazines or the like to be engaged to the adjustable pouch 100.

Figure 8:
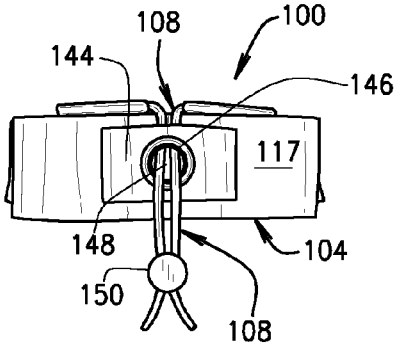
FIG. 8 is a bottom view of the adjustable pouch.

Referring to FIG. 8, a tab portion 144 may be sewn or otherwise secured along the bottom portion 117 of the pouch body 104 for securing both free ends of the first elongated elastic member 108. The tab portion 144 includes a ring 146 that defines and reinforces an opening 148 configured to receive the first elongated elastic member 108. In some embodiments, the free ends of the first elongated elastic member 108 extend through the fastener 150 and are tied together in a knot to secure the first elongated elastic member 108 to the fastener 150. In one embodiment, the fastener 150 may be a conventional fastener that includes a spring-biased portion disposed within a chamber defined by the fastener 150. The fastener 150 defines a first aperture and the spring-biased portion defines a second aperture that may be positioned to establish communication with the first aperture when the first and second apertures are substantially aligned to permit the first elongated elastic member 108 to be inserted through both the first and second apertures, thereby securing the first elongated elastic member 108 to the fastener 150.

Figure 2:
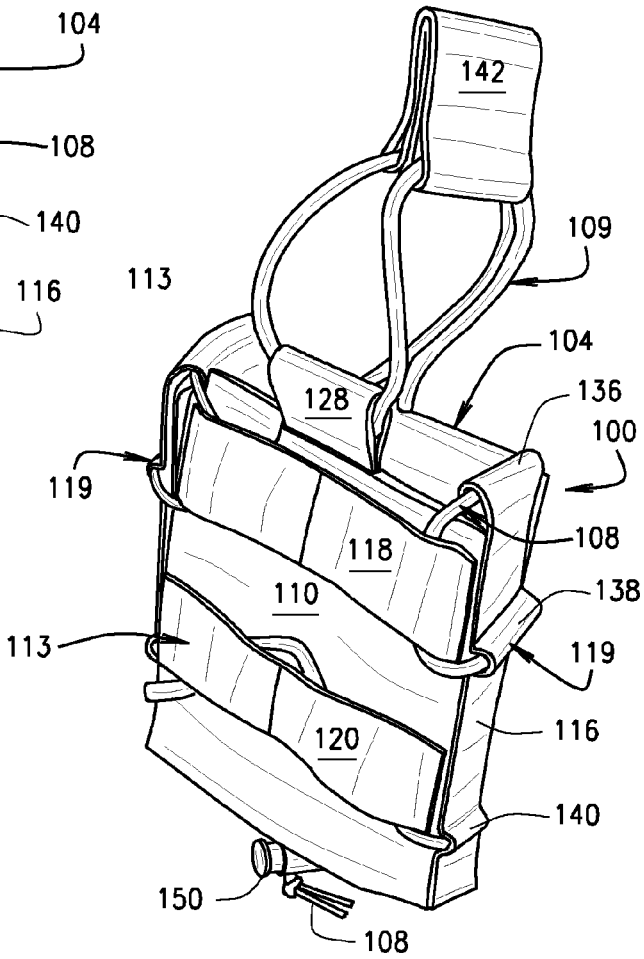
FIG. 2 is an elevated perspective view of the adjustable pouch.

Referring to FIGS. 1 and 2, in some embodiments the adjustable pouch 100 may include a retainer member 142 attached to a second elongated elastic member 109 having one portion looped through a channel defined by a tab member 128, which is secured to the front portion 110 of the pouch body 104 and another portion of the second elongated elastic member 109, which is tied to one of a plurality of straps 113 secured to the rear portion 112 of the pouch body 104. As shown in FIG. 1, the retainer member 142 engages and retains a portion of the ammunition magazine 102 within the confines of the interior space 106 of the pouch body 104.

As shown in FIGS. 1-4, in some embodiments a first plurality of straps 113 may be a first strap 118 and a second strap 120 that extend lengthwise across the front portion 110 and may be sewn or otherwise secured to the front portion 110, while in some embodiments a second plurality of straps 113 (FIG. 4) may be a third strap 122, a fourth strap 124, and a fifth strap 126 that are sewn or otherwise secured to the rear portion 112 of the pouch body 104. In other embodiments, the front portion 110 and rear portion 112 of the pouch body 104 may have any number of a plurality of straps 113 that allow the first elongated elastic member 108 to be engaged to one or more straps 113.

Figure 3:
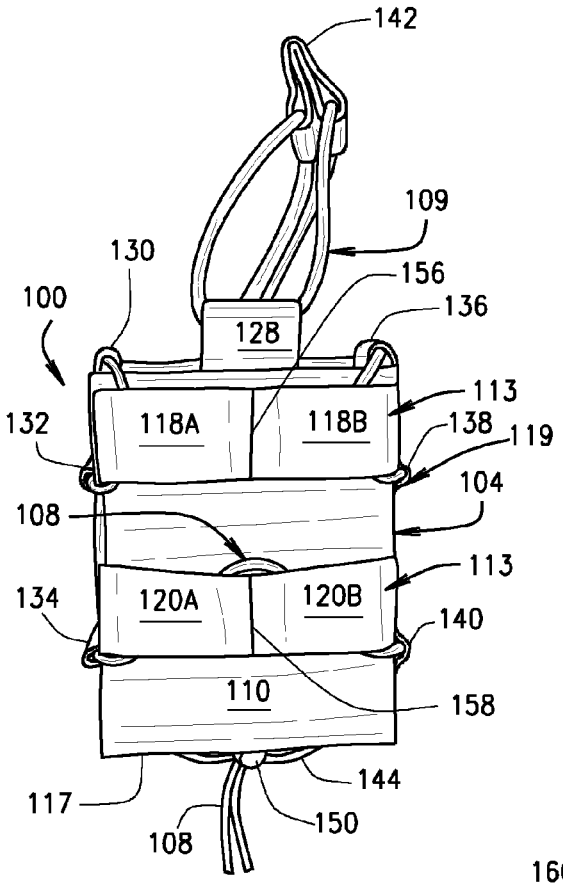
FIG. 3 is a front view of the adjustable pouch.
Figure 4:
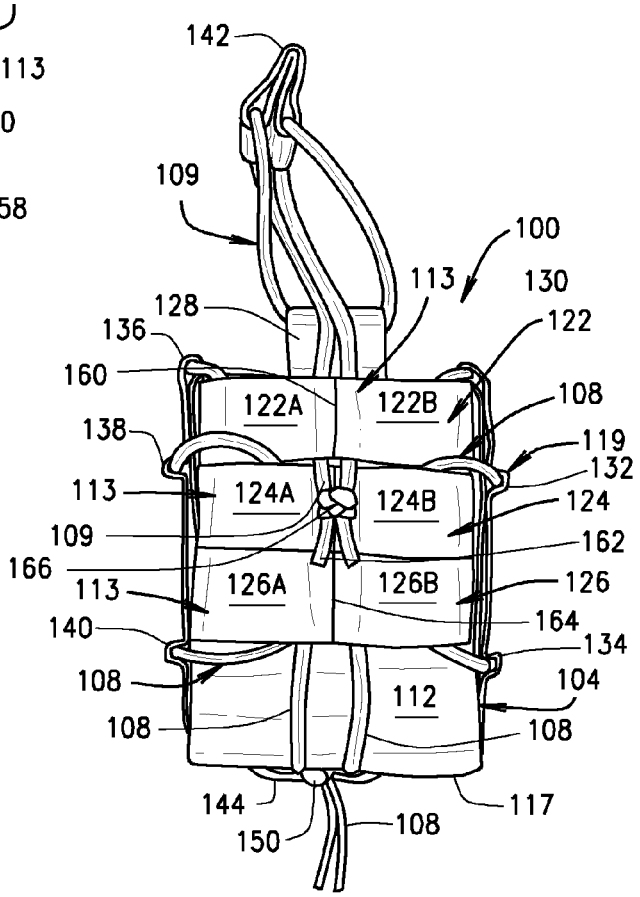
FIG. 4 is a rear view of the adjustable pouch.

Referring to FIG. 3, in some embodiments the first strap 118 may have a sewn portion 156 that divides the first strap 118 into a strap portion 118A and a strap portion 118B of substantially equal length, while the second strap 120 may have a sewn portion 158 that divides the second strap 120 into a strap portion 120A and a strap portion 120B of substantially equal length. Similarly, in some embodiments, the third strap 122 may have a sewn portion 160 that divides the third strap 122 into a strap portion 122A and a strap portion 122B of substantially equal length, while the fourth strap 124 may have a sewn portion 162 that divides the fourth strap 124 into a strap portion 124A and a strap portion 124B of substantially equal length. In addition, the fifth strap 126 may have a sewn portion 164 that divides the fifth strap 126 into a strap portion 126A and a strap portion 126B of substantially equal length. As shown, each of the strap portions 118A, 118B, 120A, 120B, 122A, 122B, 124A, 124B, 126A and 126B forms an open ended channel configured to receive a portion of the first elongated elastic member 108 when binding the pouch body 104 together as shall be discussed in greater detail below.

Figure 5:
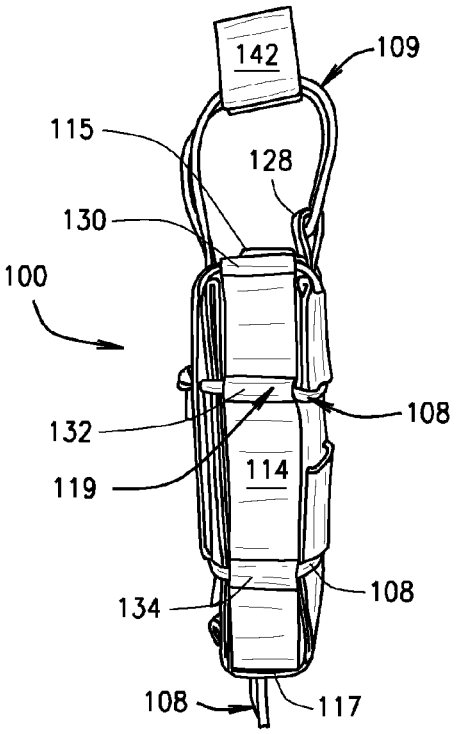
FIG. 5 is a side view of the adjustable pouch.
Figure 6:
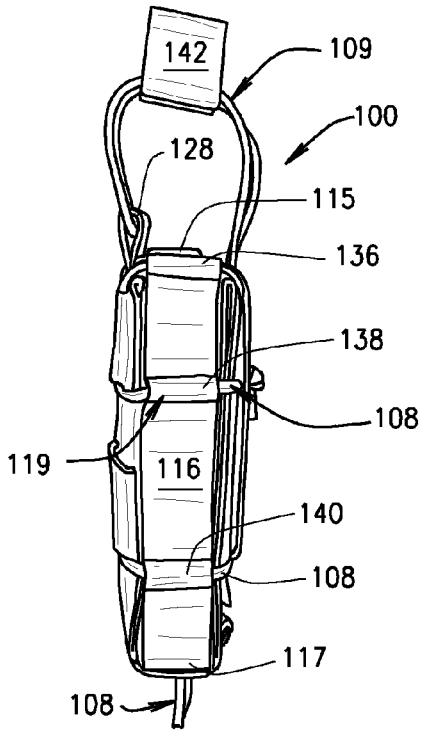
FIG. 6 is an opposing side view of the adjustable pouch.
Figure 7:
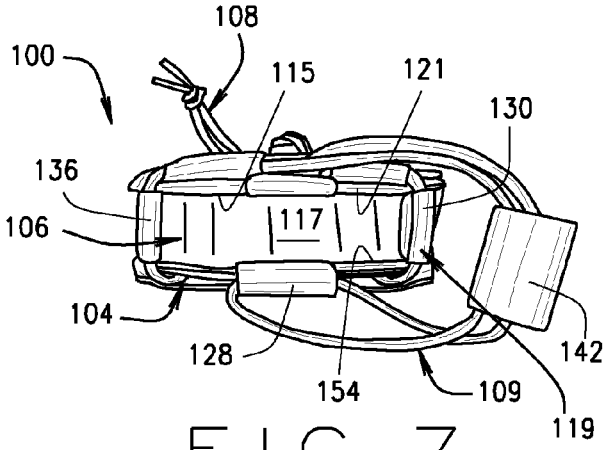
FIG. 7 is a top view of the adjustable pouch.

Referring to FIGS. 1-6, the pouch body 114 further includes a plurality of channels 113 that are defined along the first side portion 114 and the second side portion 116. The plurality of channels 113 are configured to receive respective portions of the first elongated elastic member 108 when binding the first and second side portions 114 and 116 to the front portion 110 and rear portion 112, respectively. As shown in FIG. 5, in some embodiments the first side portion 114 may define a first channel 130, a second channel 132, and a third channel 134 configured to receive a portion of the first elongated elastic member 108. Similarly, as shown in FIG. 6, in some embodiments the second side portion 116 may define a fourth channel 136, a fifth channel 138, and a sixth channel 140 that are also configured to receive a portion of the first elongated elastic member 108 when binding the pouch body 104 together.

The plurality of channels 113 formed along each the first and second side portions 114 and 116, respectively, establish contact points between the first elongated member 108 and the first and second side portions 114 and 116 such that the front portion 110, rear portion 112, first side portion 114, and second side portion 116 of the pouch body 104 are bound together with greater binding force by the first elongated member 108. In this arrangement, the plurality of channels 113 prevent the first elongated elastic member 108 from slipping or otherwise disconnecting from the first and second side portions 114 and 116 which can cause the first side portion 114 and/or second side portion 116 from becoming partially or fully unbound from the front portion 110 and/or rear portion 112.

During use of the adjustable pouch 100, an individual can insert one of many different types of ammunition magazines 102 into the interior space 106 of the pouch body 104 such that the volume of the interior space 106 can be adjusted by the first elongated elastic member 108. For example, once the ammunition magazine 102 is engaged within the pouch body 104, the individual can then grasp the fastener 150 and pull in a substantially downward manner to cinch the first elongated elastic member 108 and tighten the pouch body 104 around the ammunition magazine 102. This process allows the adjustable pouch 100 to be adjusted to accommodate the particular size of ammunition magazine 102. In particular, cinching or tightening the first elongated member 108 around the pouch body 104 causes the front portion 110, rear portion 112, first side portion 114 and second side portion 116 to substantially even tightening of the pouch body 104 around the ammunition magazine 102. This substantial even tightening around all sides of the pouch body 104 is due to the engagement of the first elongated member 108 through the plurality of channels 119 defined by the first and second side portions 114 and 116.

Figure 9:
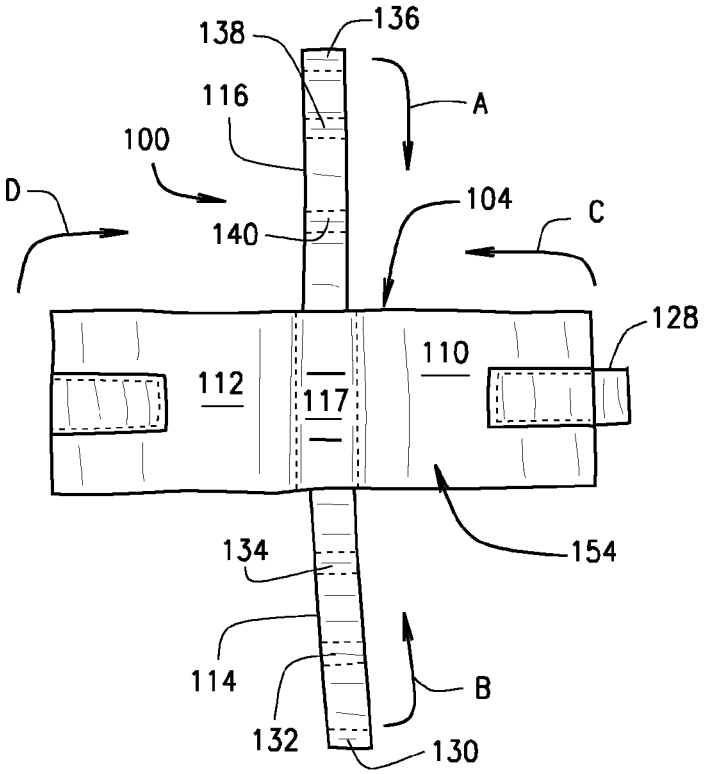
FIG. 9 is a top plan view of an interior surface of the adjustable pouch in a disassembled state.
Figure 10:
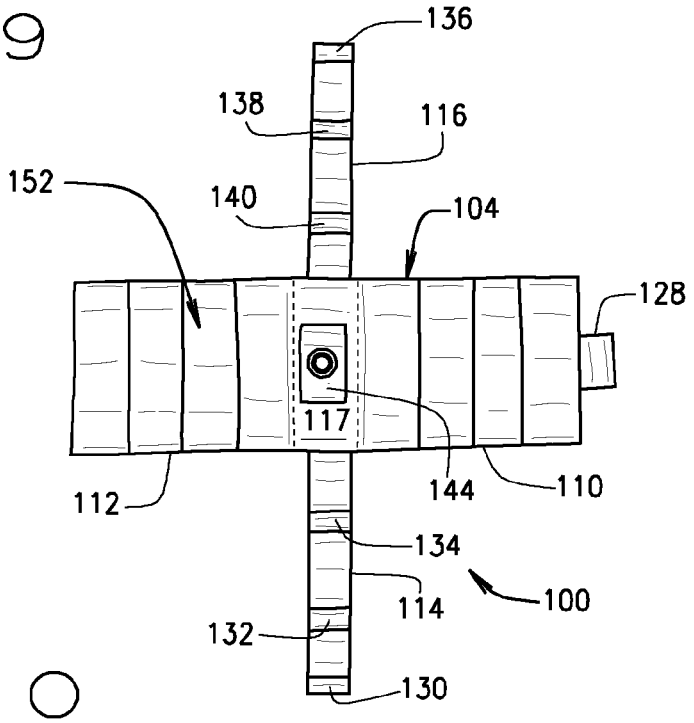
FIG. 10 is a top plan view of an exterior surface of the adjustable pouch in a disassembled state.

Referring to FIG. 9, the pouch body 104 is shown in a disassembled state prior to assembly with the interior surface 154 of the pouch body 104 being shown, while FIG. 10 illustrates the pouch body 104 in a disassembled state with the exterior surface 156 of the pouch body 104 being shown. As shown, the front portion 110, rear portion 112, first side portion 114, and second side portion 116 are connected to the bottom portion 117 in such a manner that the front portion 110, rear portion 112, first side portion 114, and second side portion 116 may bend at the connection point with the bottom portion 117. During assembly of the adjustable pouch 100, the first and second side portions 114 and 116 may be bent upward toward each other as illustrated by arrows A and B, respectively, until the first and second side portions 114 and 116 are substantially perpendicular relative to the bottom portion 117, which is kept substantially stationary during assembly. Similarly, the front portion 110 and the rear portion 112 may be bent upward toward each other as illustrated by arrows C and D, respectively, until the front and rear portions 110 and 112 are substantially perpendicular relative to the bottom portion 117.

In this configuration, the front portion 110, the rear portion 112, the first side portion 114 and the second side portion 116 collectively define the interior space 106 configured to receive the ammunition magazine 102. Once so configured, in one method of assembly the free ends of the first elongated elastic member 108 may be inserted through the respective plurality of channels 119 and plurality of straps 113 as shown in FIGS. 1-8. Once the first elongated elastic member 108 is inserted through the respective plurality of channels 119 and plurality of straps 113 the free ends are inserted through the opening 148 of the tab portion 144 and tied together through the fastener 150 as discussed above. Although FIGS. 1-8 show one method of engaging the first elongated elastic member 108 to the pouch body 104 in a binding configuration, the first elongated elastic member 108 may be engaged to the plurality of channels 119 and plurality of straps 113 in different locations and in different sequences such that an individual pulling the first elongated elastic member 108 proximate the fastener 150 causes the first elongated elastic member 108 to become more tightly bound around the front portion 110, rear portion 112, first side portion 114, and second side portion 116 of the pouch body 104, thereby allowing different sizes of ammunition magazines to be accommodated within the adjustable pouch 100.

In some embodiments, the following method of manufacture may be used to manufacture the adjustable pouch 100. One of the free ends of the first elongated elastic member 108 can be inserted through the first channel 130 and strap portion 118A and then through the second channel 132. The free end of the first elongated elastic member 108 is then inserted through the strap portions 124B and 126B and then the third channel 134 before being inserted through the strap portions 120A and 120B as shown in FIG. 3. The first elongated elastic member 108 is inserted through the sixth channel 140 and then through strap portions 126A and 124A before being inserted through the fifth channel 138. After being inserted through the fifth channel 140, the first elongated elastic member 108 is inserted through the strap portion 118B before being inserted through the third channel 136 such that both free ends of the first elongated elastic member 108 hang freely through the first channel 130 and third channel 136, respectively. The two free ends of the first elongated elastic member 108 are then inserted through the opening of the tab portion 144 before being engaged to the fastener 150 and tied together as discussed above. While a particular order of actions for the manufacture of the adjustable pouch 100 have been discussed, these actions may be performed in other temporal sequences. For example, two or more actions may be performed sequentially, concurrently, or simultaneously. Alternatively, two or more actions may be performed in reversed order. Further, one or more actions may not be performed at all. In addition, the first elongated elastic member 108 may be inserted through one or more of the channels 119 or through one or more of the straps 113 in any order to bind the pouch body 104 together. The apparatus, methods, and articles of manufacture described herein are not limited in this regard.

In some embodiments, the front portion 110, second portion 112, first side portion 114, second side portion 116, and bottom portion 117 may be made from an underlying hard plastic material covered on both sides with a durable fabric material. The hard plastic material provides a reinforcing backing structure to provide structural strength and integrity to the pouch body 104. In some embodiments, the durable fabric material may be a polyester material, a cotton material, a cotton-blend material, a polymer-based material, an animal hide material, such as leather, a burlap material, and any type of man-made or natural materials. The straps 113 may also be made from the same durable fabric material.

During manufacture of the plurality of channels 119, a first durable fabric may form the interior surface 154 of the first and second side portions 114 and 116 that covers one side of the hard plastic material, while a second durable fabric may form the exterior surface 152 of the first and second side portion 114 and 116 that covers the opposite side of the hard plastic material. When attaching the second durable fabric to the hard plastic material, the second durable plastic may be sewn such that excess durable fabric forms each respective channel 119.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. An adjustable pouch comprising:

a pouch body comprising a front portion, a rear portion, a first side portion, and a second side portion that are connected to a bottom portion and collectively define an interior space;

one or more first straps attached to the front portion of the pouch body to form a first plurality of channels defined along the front portion; and one or more second straps attached to the rear portion of the pouch body to form a second plurality of channels defined along the rear portion, wherein the one or more first straps and the one or more second straps are attached lengthwise relative to the front portion and rear portion, respectively;

a first elongated elastic member configured to be received through the first plurality of channels and the second plurality of channels such that the first elongated elastic member is adjustable to substantially even tightening of the pouch body and modify a volume of the interior space of the pouch body;

a tab member extending from either the front portion or rear portion and forming a tab channel;

a second elongated elastic member having one portion looped through the tab channel of the tab member; and a retention member defining a retention channel configured to receive another portion of the second elongated elastic member, the second elongated elastic member defining a first free end and a second free end that are attached together, wherein the retention member applies a bias to an article that is received within the interior space when the retention member is engaged to the article.

2. The adjustable pouch of claim 1, wherein the first elongated elastic member defines a first free end and a second free end that are secured together through a fastener.

3. The adjustable pouch of claim 1, further comprising:

a tab portion attached to the bottom portion of the pouch body, wherein the tab portion defines an opening configured to receive the first elongated elastic portion.

4. The adjustable pouch of claim 3, wherein the tab portion includes a ring that defines the opening.

5. The adjustable pouch of claim 1, wherein the second elongated elastic member comprises a rope, a chord, a string, or other type of elongated stretchable member.

6. The adjustable pouch of claim 1, wherein each of the one or more first and second straps includes a sewn portion that divides each of the one or more first and second straps into a pair of respective strap portions.

7. The adjustable pouch of claim 1, wherein the first elongated elastic member includes a first free end and a second free end that are tied together and configured to be manipulated for cinching the first elongated elastic member relative to the pouch body to change the volume of the interior space.

8. The adjustable pouch of claim 1, wherein the interior space communicates with an opening collectively defined by the front portion, rear portion, first side portion, and second side portion.

9. The adjustable pouch of claim 1, wherein the first elongated elastic member includes a rope, a chord, a string, or other type of elongated stretchable member.

10. The adjustable pouch of claim 1, wherein the front portion, rear portion, first side portion, and second side portion are bendable at the respective junction with the bottom portion.

11. An adjustable pouch comprising:

a pouch body including a front portion, a rear portion, a first side portion, and a second side portion that are each bendable along a corresponding connection point with a bottom potion and collectively define an interior space, respective edges of the front portion, the rear portion, the first side portion, and the second side portion unattached to each other;

one or more first straps attached lengthwise to the front portion of the pouch body to define at least one front portion channel;

one or more second straps attached lengthwise to the rear portion of the pouch body to define at least one rear portion channel;

a first elongated member extending through the at least one front portion channel and the at least one rear portion channel thereby connecting the front portion, the rear portion, the first side portion, and the second side portion, such that the first elongated member is adjustable to tighten the pouch body and modify a volume of the interior space of the pouch body by dynamically adjusting a distance between each of the respective edges;

a tab member extending from either the front portion or rear portion and forming a tab channel;

a second elongated elastic member having one portion looped through the tab channel of the tab member; and a retention member defining a retention channel configured to receive another portion of the second elongated elastic member, the second elongated elastic member defining a first free end and a second free end that are attached together, wherein the retention member applies a bias to an article that is received within the interior space when the retention member is engaged to the article.

12. The adjustable pouch of claim 11, wherein the first elongated member or the second elongated member includes a tied portion defined over the pouch body.

13. The adjustable pouch of claim 11, wherein a portion of the first elongated member or the second elongated member is disposed around a peripheral region of the article.

14. The adjustable pouch of claim 1, wherein the first free end and the second free end of the second elongated elastic member are attached together by tying.

15. The adjustable pouch of claim 11, wherein the first free end and the second free end of the second elongated elastic member are attached together by tying.

16. The adjustable pouch of claim 1, wherein the article is an ammunition magazine.

17. The adjustable pouch of claim 11, wherein the article is an ammunition magazine.

18. The adjustable pouch of claim 11, wherein the first elongated elastic member defines a first free end and a second free end that are secured together through a fastener.

19. The adjustable pouch of claim 11, further comprising:

a tab portion attached to the bottom portion of the pouch body, wherein the tab portion defines an opening configured to receive the first elongated elastic portion.

20. The adjustable pouch of claim 19, wherein the tab portion includes a ring that defines the opening.

21. The adjustable pouch of claim 11, wherein the second elongated elastic member comprises a rope, a chord, a string, or other type of elongated stretchable member.

22. The adjustable pouch of claim 11, wherein the first elongated elastic member comprises a rope, a chord, a string, or other type of elongated stretchable member.

23. The adjustable pouch of claim 11, wherein a sewn portion divides the one or more first straps.

24. The adjustable pouch of claim 11, wherein the one or more first straps are divided into a first strap portion and a second strap portion.

25. The adjustable pouch of claim 11, further comprising:

at least one first side channel defined by the first side portion; and at least one second side channel defined by the second side portion.

26. The adjustable pouch of claim 1, further comprising:

at least one first side channel defined by the first side portion; and at least one second side channel defined by the second side portion.

27. The adjustable pouch of claim 1, wherein the front portion, the rear portion, the first side portion, and the second side portion are flexibly connected to the bottom portion.

28. The adjustable pouch of claim 11, wherein the one or more first straps includes an upper strap and a lower strap.

* * * * *